US006742591B2

(12) United States Patent
Metcalfe

(10) Patent No.: US 6,742,591 B2
(45) Date of Patent: Jun. 1, 2004

(54) DOWNHOLE APPARATUS

(75) Inventor: Paul David Metcalfe, Peterculter (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/357,180

(22) Filed: Feb. 3, 2003

(65) Prior Publication Data

US 2003/0116318 A1 Jun. 26, 2003

Related U.S. Application Data

(62) Division of application No. 09/956,717, filed on Sep. 20, 2001.

(30) Foreign Application Priority Data

Sep. 20, 2000 (GB) ..... 0023032

(51) Int. Cl.[7] ..... E21B 33/14

(52) U.S. Cl. ..... 166/285; 166/177.4; 166/207

(58) Field of Search ..... 166/285, 281, 166/289, 290, 305.1, 383, 177.4, 207

(56) References Cited

U.S. PATENT DOCUMENTS

| | | | |
|---|---|---|---|
| 761,518 | A | 5/1904 | Lykken |
| 1,324,303 | A | 12/1919 | Carmichael |
| 1,459,990 | A | 6/1923 | Reed |
| 1,545,039 | A | 7/1925 | Deavers |
| 1,561,418 | A | 11/1925 | Duda |
| 1,569,729 | A | 1/1926 | Duda |
| 1,597,212 | A | 8/1926 | Spengler |
| 1,930,825 | A | 10/1933 | Raymond |
| 1,981,525 | A | 11/1934 | Price |
| 2,214,226 | A | 9/1940 | English |
| 2,216,226 | A | 10/1940 | Bumpous |
| 2,344,120 | A | 3/1944 | Baker |
| 2,345,308 | A | 3/1944 | Wallace |
| 2,383,214 | A | 8/1945 | Prout |
| 2,499,630 | A | 3/1950 | Clark |
| 2,627,891 | A | 2/1953 | Clarka |
| 2,663,073 | A | 12/1953 | Bieber et al. |
| 2,898,971 | A | 9/1959 | Hempel |

(List continued on next page.)

FOREIGN PATENT DOCUMENTS

| | | | |
|---|---|---|---|
| EP | 0 961 007 | 12/1999 | ..... E21B/33/10 |
| GB | 887150 | 1/1962 | |
| GB | 1 448 304 | 9/1976 | ..... E21B/33/13 |
| GB | 2 216 926 | 10/1989 | ..... E21B/7/20 |
| GB | 2 221 482 | 2/1990 | ..... E21B/33/14 |
| GB | 2 320 734 | 7/1998 | ..... E21B/33/127 |
| GB | 2 326 896 A | 1/1999 | ..... E21B/17/00 |
| GB | 2 329 918 | 4/1999 | ..... E21B/43/10 |
| WO | WO 93/24728 | 12/1993 | ..... E21B/17/10 |
| WO | WO 99/18328 | 4/1999 | ..... E21B/23/01 |
| WO | WO 99/23354 | 5/1999 | ..... E21B/43/10 |
| WO | WO 99/35368 | 7/1999 | ..... E21B/43/10 |
| WO | WO 00/37772 | 6/2000 | ..... E21B/43/10 |
| WO | WO 00/37773 | 6/2000 | ..... E21B/43/10 |
| WO | WO 01/60545 | 8/2001 | ..... B21D/39/00 |

OTHER PUBLICATIONS

International Search Report, International App. No. PCT/IL00/00245, dated Sep. 18, 2000.
Search Report from GB 0023032.6, Dated Jan. 12, 2001.
International Search Report, International Application No. PCT/GB 01/04202, dated Oct. 12, 2001.

*Primary Examiner*—Zakiya Walker
(74) *Attorney, Agent, or Firm*—Moser, Patterson & Sheridan, L.L.P.

(57) ABSTRACT

Apparatus (10) for facilitating coupling and cementing of downhole tubulars (12, 28) comprises a tubing section (12, 10) for use in lining a bore. The tubing section has upper and lower ends and defines a tubing wall having cement outlets (20) spaced from the lower end of the tubing. The lower end of the tubing is selectively closed, and swab cups (22) are provided externally of the lower end of the tubing below the cement outlets (20) for restricting passage of cement.

20 Claims, 4 Drawing Sheets

U.S. PATENT DOCUMENTS

| | | | | | |
|---|---|---|---|---|---|
| 3,087,546 | A | | 4/1963 | Wooley | 166/46 |
| 3,191,677 | A | | 6/1965 | Kinley | 166/14 |
| 3,195,646 | A | | 7/1965 | Brown | 166/208 |
| 3,467,180 | A | | 9/1969 | Pensotti | 165/180 |
| 3,712,376 | A | | 1/1973 | Owen et al. | 166/277 |
| 3,776,307 | A | | 12/1973 | Young | 166/125 |
| 3,818,734 | A | | 6/1974 | Bateman | 72/75 |
| 3,911,707 | A | | 10/1975 | Minakov et al. | 72/76 |
| 3,948,321 | A | | 4/1976 | Owen et al. | 166/277 |
| 4,069,573 | A | | 1/1978 | Rogers, Jr. et al. | 29/421 R |
| 4,127,168 | A | | 11/1978 | Hanson et al. | 166/123 |
| 4,159,564 | A | | 7/1979 | Cooper, Jr. | 29/727 |
| 4,288,082 | A | | 9/1981 | Setterberg, Jr. | 277/125 |
| 4,319,393 | A | | 3/1982 | Pogonowski | 29/434 |
| 4,324,407 | A | | 4/1982 | Upham et al. | 277/27 |
| 4,429,620 | A | | 2/1984 | Burkhardt et al. | 91/395 |
| 4,469,174 | A | | 9/1984 | Freeman | |
| 4,531,581 | A | | 7/1985 | Pringle et al. | 166/120 |
| 4,588,030 | A | | 5/1986 | Blizzard | 166/120 |
| 4,697,640 | A | | 10/1987 | Szarka | 166/120 |
| 4,848,469 | A | | 7/1989 | Baugh et al. | 166/382 |
| 5,024,273 | A | | 6/1991 | Coone et al. | 166/289 |
| 5,052,483 | A | | 10/1991 | Hudson | 166/55 |
| 5,271,472 | A | | 12/1993 | Leturno | 175/107 |
| 5,303,772 | A | | 4/1994 | George et al. | 166/55.1 |
| 5,348,095 | A | | 9/1994 | Worrall et al. | 166/380 |
| 5,409,059 | A | | 4/1995 | McHardy | 166/208 |
| 5,435,400 | A | | 7/1995 | Smith | 175/61 |
| 5,472,057 | A | | 12/1995 | Winfree | 175/57 |
| 5,560,426 | A | | 10/1996 | Trahan et al. | 166/120 |
| 5,667,011 | A | * | 9/1997 | Gill et al. | 166/295 |
| 5,685,369 | A | | 11/1997 | Ellis et al. | 166/195 |
| 5,718,288 | A | | 2/1998 | Bartet et al. | 166/287 |
| 5,791,416 | A | * | 8/1998 | White et al. | 166/285 |
| 5,901,787 | A | | 5/1999 | Boyle | 166/135 |
| 6,021,850 | A | | 2/2000 | Wood et al. | 166/380 |
| 6,029,748 | A | | 2/2000 | Forsyth et al. | 166/380 |
| 6,070,671 | A | | 6/2000 | Cumming et al. | 166/381 |
| 6,085,838 | A | * | 7/2000 | Vercaemer et al. | 166/277 |
| 6,098,717 | A | | 8/2000 | Bailey et al. | 166/382 |
| 6,223,823 | B1 | * | 5/2001 | Head | 166/290 |
| 6,325,148 | B1 | | 12/2001 | Trahan et al. | 166/297 |
| 6,425,444 | B1 | | 7/2002 | Metcalfe et al. | 166/387 |
| 6,446,323 | B1 | | 9/2002 | Metcalfe et al. | 29/523 |
| 6,457,532 | B1 | | 10/2002 | Simpson | 166/380 |
| 2001/0040054 | A1 | | 11/2001 | Haugen et al. | |
| 2001/0045284 | A1 | | 11/2001 | Simpson et al. | |
| 2002/0145281 | A1 | | 10/2002 | Metcalfe et al. | |
| 2002/0166668 | A1 | | 11/2002 | Metcalfe et al. | |

* cited by examiner

DOWNHOLE APPARATUS

CROSS-REFERENCE TO RELATED APPLICATIONS

This application is a divisional of co-pending U.S. patent application Ser. No. 09/956,717, filed Sep. 20, 2001, which is herein incorporated by reference.

FIELD OF THE INVENTION

This invention relates to downhole apparatus, and in particular to an apparatus, and also to a related method, for facilitating cementing and coupling of downhole tubing sections.

BACKGROUND OF THE INVENTION

In oil and gas exploration and production operations, bores are drilled from surface to access subsurface hydrocarbon-bearing formations. The bores are lined with bore wall-stabilising metal tubing, generally known as casing or liner, which is cemented in the drilled bore. Bores are typically drilled in sections, with casing being run in to line each bore section as soon as possible following completion of the drilling operation. The cementing operation is generally carried out immediately after the casing has been run into the drilled bore. Typically, cement slurry is circulated from surface through the running string on which the casing is supported, through the casing itself, through an opening in a shoe on the end of the casing, and then up through the annulus between the casing and the wall of the drilled bore.

There are many difficulties associated with achieving a successful cementing operation, for example it is necessary to allow the fluid displaced from the annulus by the cement to pass into the bore, and this may require the provision of complex porting arrangements. Further, achieving an even distribution of cement around the casing is known to be problematic. Further, a conventional cementing operation not only fills the annulus between the casing and the bore wall with cement, but also produces a slug of cement in the end of the bore, which must be drilled out if the bore is to be extended further.

Similar problems are also experienced when cementing expandable tubing, and in cementing casing and liners in "monobore" wells, that is where successive sections of casing or liner are of similar diameter. WO 99/35368 (Shell Internationale Research Maatschappij B. V.) describes a method for drilling and completing a hydrocarbon production well. In one embodiment, a well is lined by successive sections of casing which are expanded in the bore using an expansion mandrel to create a cased bore of substantially constant cross section. Adjacent casing sections overlap, and when the expansion mandrel reaches the overlap the lower casing section further expands the previously expanded upper casing section to create a sealed bond. The document recognises that this will involve increased expansion forces, and it is suggested that the bottom of the upper casing section may be pre-expanded and/or provided with slits or grooves which widen or break open during the expansion process. However, it is noted that the former option would only be available in the first casing section, and only if the first casing section was itself not subject to expansion; subsequent casing sections could not be run through previous cased sections of bore if they had been pre-expanded. Further, it is likely that the latter proposal, that is providing slits or grooves, would weaken the resulting bond and make creation of a sealed bond more difficult. The proposed bore-casing system also overlooks the difficulties involved in expanding a section of previously cemented casing; where there is set cement filling the annulus between the casing and the bore wall, it is likely to be difficult if not impossible to expand the casing.

It is among the objectives of embodiments of the present invention to obviate and mitigate these and other disadvantages of the prior art. It is among further objectives of embodiments of the present invention to provide apparatus and methods suitable for cementing expandable tubing, and in cementing casing and liners in "monobore" wells, that is where successive sections of casing or liner are of similar diameter.

SUMMARY OF THE INVENTION

According to the present invention there is provided apparatus for facilitating coupling and cementing of downhole tubulars, the apparatus comprising a tubing section for use in lining a bore, the tubing section having upper and lower ends and defining a tubing wall having cement outlets spaced from the lower end of the tubing, means for closing the lower end of the tubing, and means for location externally of the lower end of the tubing below the cement outlets for restricting passage of cement.

According to another aspect of the present invention there is provided a method of locating and cementing a section of tubing in a drilled bore, the method comprising the steps of:

providing a tubing section for use in lining a bore;

running the tubing section into a drilled bore;

passing cement slurry into the tubing section and directing the slurry into an annulus between the tubing and the bore wall to substantially fill the annulus while maintaining a lower portion of the annulus substantially clear of cement.

The invention thus allows a tubing section, such as a section of bore casing or liner, to be run into a bore and cemented while leaving a lower portion of the annulus clear of cement. This facilitates the subsequent expansion of the corresponding lower portion of the tubing section, allowing a subsequent tubing section to be, for example, expanded and coupled to the lower portion of the tubing section while also expanding said lower portion, to create a monobore well.

It will be understood by those of skill in the art that the terms "upper" and "lower" refer to the relative locations of the ends of tubing section in use, and are not intended to be limiting. Also, the apparatus may be utilised in horizontal or inclined bores. Further, references to "cement" and "cement slurry" are intended to encompass any suitable settable material for use in the execution of the invention.

Preferably, the tubing section is expandable. The tubing section may be expanded prior to passing the cement slurry into the annulus, but is preferably expanded after passing the cement slurry into the annulus, before the cement has set; the relatively large annulus which exists prior to expansion of the tubing section will facilitate flow of cement through and into the annulus. Alternatively, or in addition, the apparatus comprises one or more further tubing sections which are expandable.

Preferably, the cement outlets, which may be in the form of vents, are initially closed, such that fluid may be circulated through the length of the tubing section as the tubing is run into the bore. This may be achieved by the provision of an isolation sleeve or other vent isolation member or arrangement. Preferably, the isolation sleeve is movable to open the vents. The sleeve may be movable by any appropriate mechanism or means, for example the sleeve may be fluid flow or pressure responsive. In a preferred embodiment, the sleeve defines a flow aperture which may be selectively closed by, for example, dropping a ball from surface, such that fluid pressure above the sleeve may then be utilised to move the sleeve to a position in which the vents are opened. The sleeve and ball may thus provide means for closing the lower end of the tubing, although the closing means may take other forms, for example a plug or valve, typically a float valve. The sleeve may be drillable, or alternatively may be retrievable.

Preferably, the cement outlets are closable on expansion of the tubing. The outlets may be formed by louvres in the tubing wall, such that radial compression forces acting on the tubing wall tend to close the louvres.

Preferably, the means for restricting passage of cement are deformable or flexible, and may be in the form of swab cups, radially extending elastomeric members, foamed members or honeycomb structure members. Most preferably, the said means will deform to permit expansion of the adjacent tubing section.

Preferably, the apparatus includes a wiper plug, for movement through the tubing section to displace cement therebelow and wipe cement residue from the interior face of the tubing section. Preferably, the wiper plug is initially retained in a position at or above the upper end of the tubing section, and is releasable for movement through the tubing section. The wiper plug may be releasable on being engaged by a support string wiper dart or other member, injected into the support string and following the slug of cement slurry into the tubing section.

Preferably, the apparatus further includes an expander for expanding the tubing section. The expander may take any appropriate form, including an expansion cone or mandrel, but is most preferably a rotary expansion device as described in WO00/37772 and U.S. patent application Ser. No. 09/469,526.

According to a further aspect of the present invention there is provided apparatus for facilitating coupling and cementing of downhole tubulars, the apparatus comprising a shoe for coupling to a tubing section for use in lining a bore, the shoe defining a wall having cement outlets spaced from the lower end thereof, means for selectively closing the lower end of the shoe, and means for location externally of the lower end of the shoe, below the cement outlets, for restricting passage of cement.

According to a still further aspect of the invention there is provided a method of locating a section of tubing in a drilled bore, the method comprising the steps of:

running a tubing section into a drilled bore; and directing cement slurry into an annulus between the tubing and the bore wall to substantially fill the annulus while restricting cement access to a portion of the annulus around a selected portion of the tubing section.

This facilitates subsequent expansion of the tubing section at said selected portion to, for example, form a tubing coupling at any desired location, or to allow subsequent creation of a tool or device-mounting profile in the tubing section. The said selected portion of the tubing section may be of relatively short length, or may extend over most or all of the length of the tubing section. Alternatively, a plurality of spaced selected portions may be provided along the length of the tubing section.

Access to said portion of the annulus may be restricted by provision of a sleeve over the said selected portion of the tubing section. The sleeve preferably prevents or limits cement slurry access to an expansion-accommodating annulus around the tubing section and, depending of the location of the sleeve on the tubing section, and the extent of the sleeve, may permit circulation of cement slurry between the sleeve and the bore wall. The sleeve may enclose a hollow volume between the sleeve and the tubing section wall, but is preferably of a deformable or frangible material selected to withstand downhole pressures but which will accommodate subsequent expansion of the tubing section. The sleeve may be continuous, but may also take the form of radially extending fins, or fingers, rods or the like. The spaces between the fins may become filled or partially filled by cement, however the discontinuous or interrupted nature of the cement will be such that the cement will fracture to permit expansion of the tubing section.

The present invention thus also relates to a tubing section adapted to be cemented in a bore and which is expandable over at least a portion of its length from a first diameter to a larger second diameter, the tubing section carrying a deformable member adapted to at least partially exclude cement slurry from a volume surrounding the tubing section and to accommodate subsequent expansion of the tubing section to said larger second diameter.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
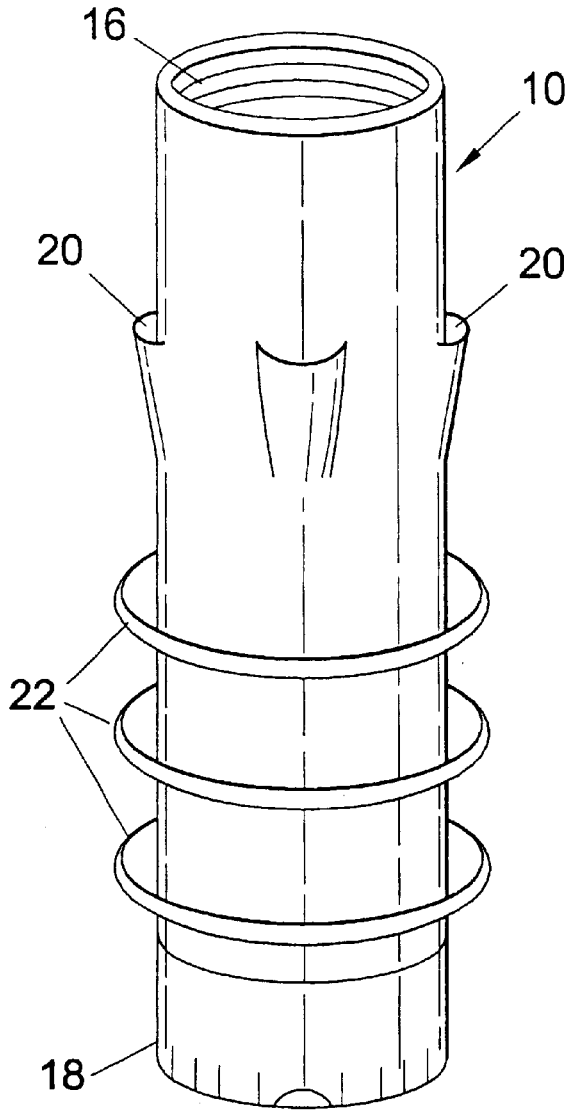
FIG. 1 is a perspective view of apparatus for facilitating coupling and cementing of downhole tubulars in accordance with a preferred embodiment of the present invention.
Figure 3:
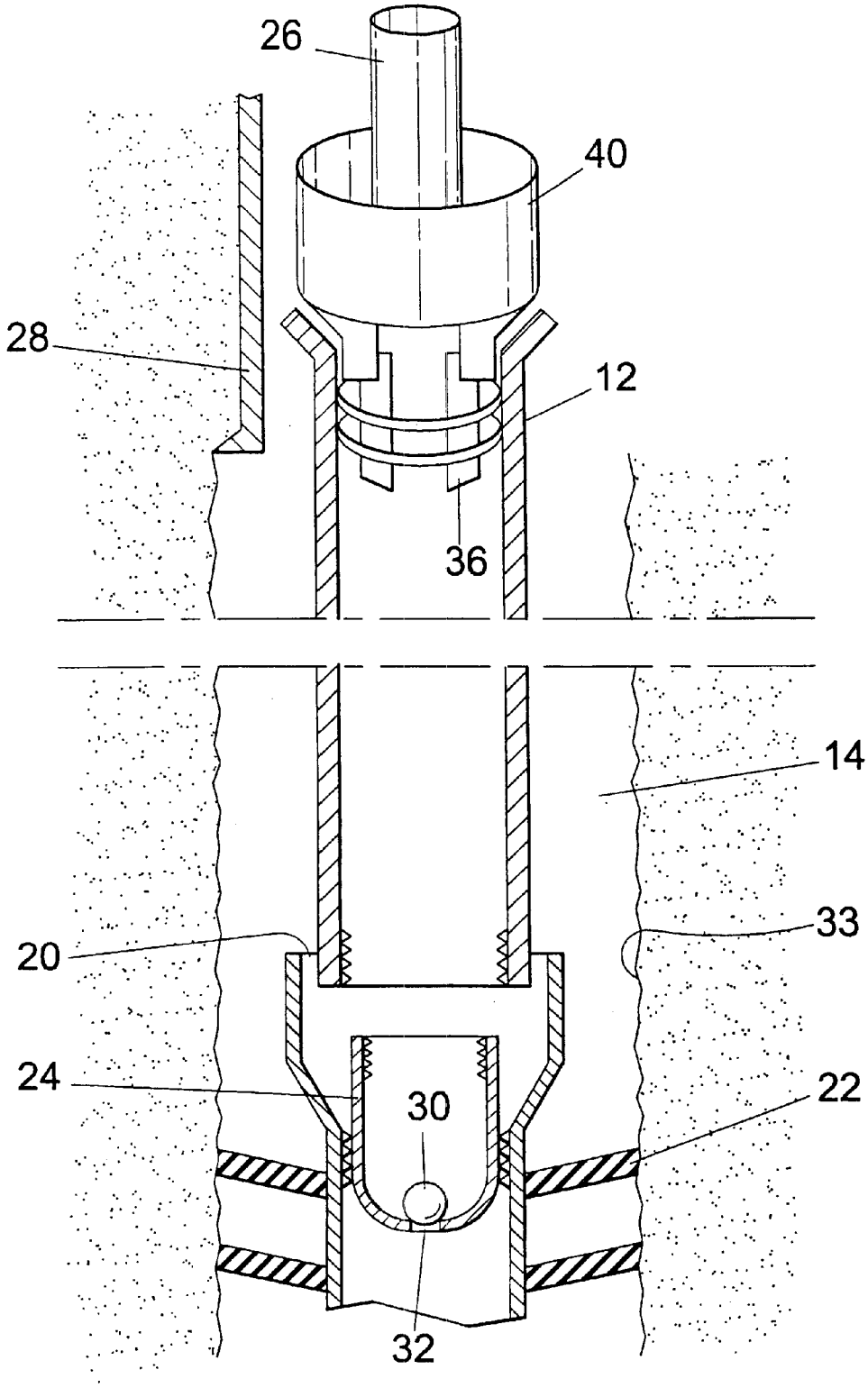
FIG. 3 is a sectional view of the apparatus of FIG. 1 shown located in a drilled bore, in the course of a cementing operation.

Reference is first made to FIG. 1 of the drawings, which illustrates apparatus for facilitating coupling and cementing of downhole tubulars, the apparatus being in the form of an expandable shoe 10 adapted for location on the lower end of a section of expandable bore liner 12 (FIG. 3). As will be described, the shoe 10 permits circulation of fluid while the liner 12 is being run into the bore and then permits selective filling of the annulus 14 (FIG. 3) surrounding the liner 12 with cement before expansion of the liner 12.

The shoe 10 is tubular and includes an expandable coupling 16 at its upper end for connecting the shoe 10 to the liner 12. The lower end of the shoe 10 is provided with a float shoe 18 which is releasably mounted on the shoe 10. Cement outlets in the form of louvred vents 20 are provided in the wall of the shoe 10 and, as will be described, allow cement to be passed from the interior of the shoe 10 into the annulus 14. Three rows of swab cups 22 are provided on the exterior of the shoe 10 below the vents 20 and restrict cement access to the area of the annulus 14 occupied by the swab cups 22.

Figure 2:
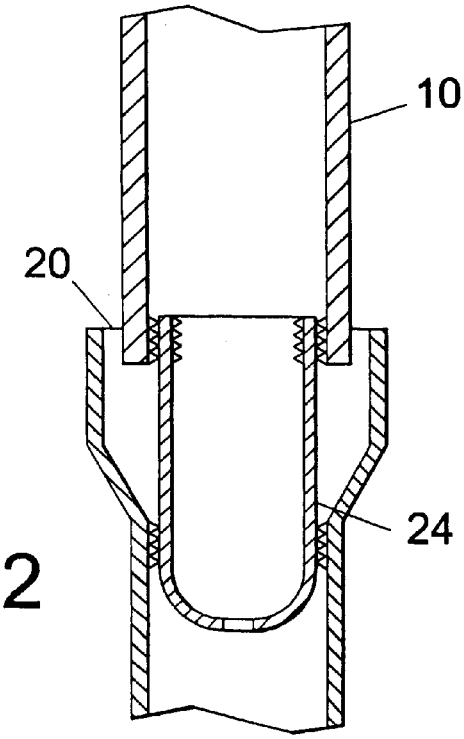
FIG. 2 is a sectional view of part of the apparatus of FIG. 1 in a running configuration.

Reference is now also made to FIG. 2 of the drawings, which is a cross-sectional view of part of the shoe 10 in the vicinity of the cement vents 20. Initially, the vents 20 are isolated from the interior of the shoe 10 by a sleeve 24. Thus, as the shoe 10 and liner 12 are being run into a bore, fluid may be circulated through the supporting drill pipe 26 (FIG. 3), the liner 12, the shoe 10, and the float shoe 18, to facilitate passage of the liner 12 into the bore.

FIG. 3 of the drawings shows the liner 12 after it has been run into the bore, with the upper end of the liner 12 overlapping the lower end of an existing section of casing 28. If a ball 30 is then dropped from surface and through the drill pipe 26 and liner 12, the ball 30 closes a flow port 32 in the sleeve 24, and an increase in fluid pressure above the sleeve 24 then releases the sleeve from its initial position, and allows fluid communication through the cement vents 20; the sleeve 24 is caught in the shoe 10, below the vents 20.

A predetermined volume of cement slurry is then passed down the drill pipe 26 and into the liner 12 and shoe 10, the cement flowing from the shoe 10 into the annulus 14, via the vents 20. The cement displaces the fluid occupying the annulus 14, which is free to pass upwardly between the upper end of the liner 12 and the casing 28. However, the swab cups 22, which are dimensioned to engage the bore wall 33, prevent cement from flowing into the portion of the annulus occupied by the swab cups 22. Further, as the ball 30 has closed the sleeve 24, cement cannot flow down through the lower end of the shoe 10.

Figure 4:
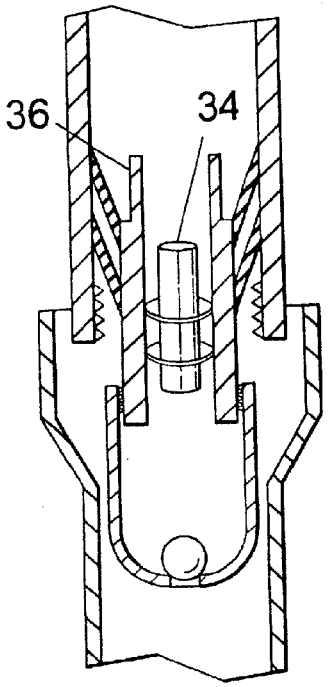
FIG. 4 is a sectional view of part of the apparatus of FIG. 1 at a later stage in a cementing operation.

The cement slurry is followed through the drill pipe 26 by a drill pipe wiper dart 34, as illustrated in FIG. 4, which is adapted to engage a liner wiper plug 36 provided at the upper end of the liner 12. On the dart 34 engaging the plug 36, the plug 36 is released and passes down through the liner 12 with the dart 34. The plug 36 and dart 34 move downwardly through the shoe 10 until encountering the isolation sleeve 24, the plug 36 and dart 34 being positioned relative to the vents such that the wiper blades on the plug 36 prevent further passage of cement slurry or fluid from the shoe 10 through the vents 20.

A rotary expander 40 which serves to mount the liner 12 on the drill string 26 is then activated to expand the liner 12 to provide initial engagement with the casing 28, and then by rotating and advancing the expander 40 the liner 12 is expanded to a larger diameter, while the cement slurry is still liquid. The expander 40 is a rotary expandable device, as described in our U.S. patent application Ser. No. 09/469,526, the disclosures of which is incorporated herein by reference.

Figure 5:
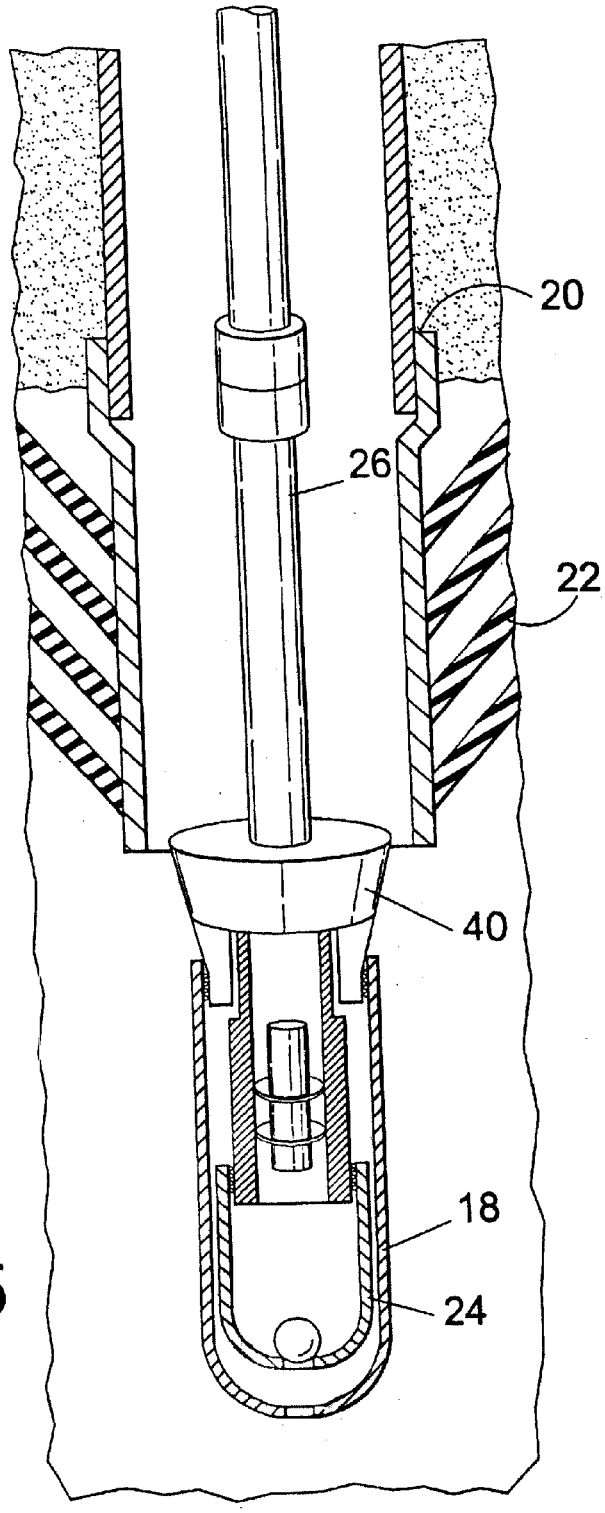
FIG. 5 is a sectional view of a part of the apparatus of FIG. 1 shown in a bore following completion of a cementing operation.

As illustrated in FIG. 5, on the expander 40 reaching the vents 20, the expansion of the liner 12 closes the vents 20, creating a seal between the cement slurry in the annulus 14 and the interior of the shoe 10. As the expander 40 continues, it engages the plug 36 and dart 34, and the isolation sleeve 24, which are together pushed into the float shoe 18. Continuing advancement of the expander 40 shears the shoe 18 from the end of the liner 12, and the expander 40 engages the shoe 18. If the expander 40 is then deactivated, the drill pipe 26 may be retrieved, together with the expander 40 and the float shoe 18 containing the sleeve, dart and plug 24, 34, 36.

As may be clearly seen from FIG. 5, the described cementation process leaves the annulus surrounding the lower end of the shoe 10 clear of cement and occupied only by the deformable swab cups 22. Thus, when a further length of expandable liner or tubing is run into the bore, and placed in overlapping relation with the lower end of the shoe 10, the upper end portion of the further liner may be expanded and in turn expand the lower end of the shoe 10 to create a secure, sealed coupling between the liner sections.

Figure 6:
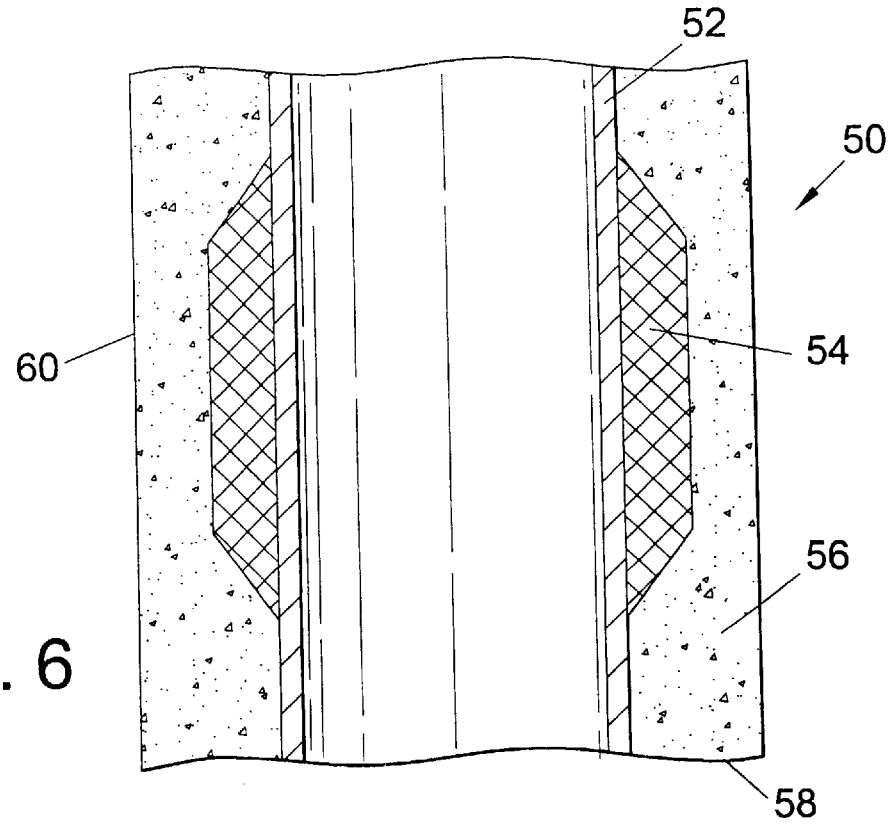
FIG. 6 is a schematic sectional view of an arrangement for facilitating expansion of cemented tubing in accordance with an embodiment of a further aspect of the present invention.

Reference is now made to FIG. 6 of the drawings, which is a schematic sectional view of an arrangement 50 for facilitating expansion of cemented tubing in accordance with an embodiment of a further aspect of the present invention. The arrangement comprises a tubing section; in this case a section of metal bore-lining casing 52, carrying a sleeve 54 of a deformable material. Cement slurry 56 has been circulated in the annulus 58 between the casing 52 and the bore wall 60; around the sleeve 54, the cement 56 is kept spaced from the outer surface of the casing 52, however there is sufficient spacing between the surface of the sleeve 54 and the bore wall 60 to allow circulation of cement slurry 56 past the sleeve 54. Indeed, the sleeve 54 may serve as a centraliser, as the tubing section is being run in and may for example define external flutes.

As with the first described embodiment, the casing 52 may be expanded before the cement slurry 56 has set. Further, the provision of the sleeve 54 allows for further subsequent expansion of the casing 52 in the region of the sleeve 54 after the cement has hardened; such expansion of the casing 52 is accommodated by deformation and flow of the sleeve material, as illustrated in FIG. 7 of the drawings.

Figure 7:
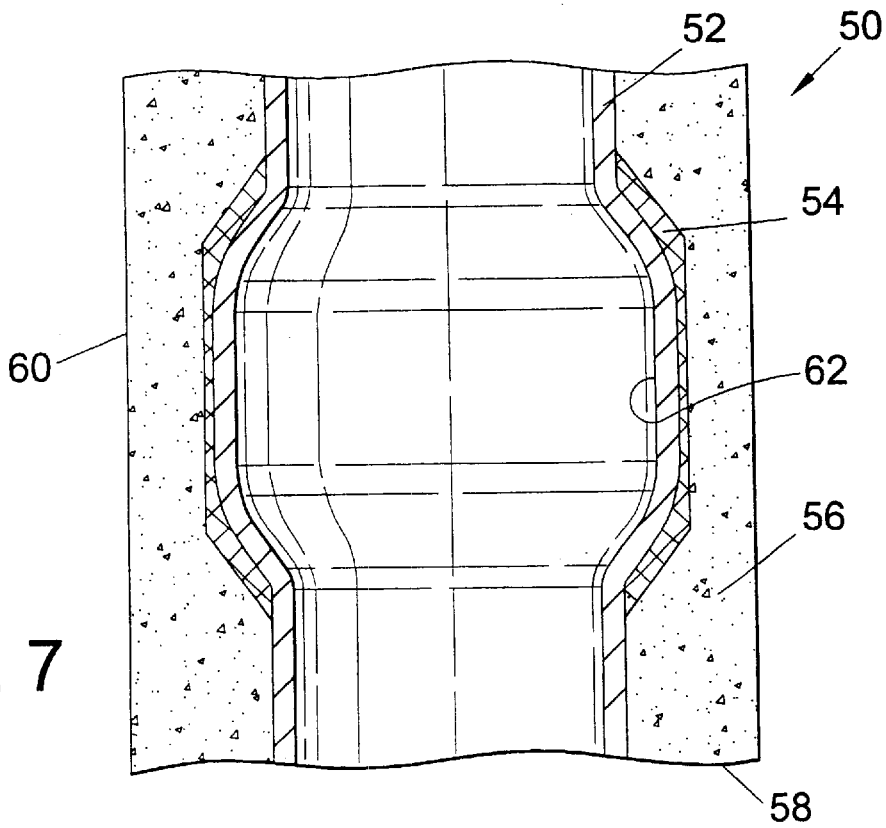
FIG. 7 is a schematic sectional view of the tubing of FIG. 6 following expansion.

FIG. 7 illustrates a profile 62 which has been created by expansion of the casing 52 into the volume occupied by the sleeve, which profile 62 may be utilised for mounting a tool or device in the casing 52.

In other embodiments, a number of spaced deformable sleeves may be provided on a casing section, or a sleeve may be provided over the length of the casing section. With the latter embodiment, this arrangement would allow the expansion or further expansion of the cemented casing at any point on its length. This would allow for the creation of an overlapping expanded coupling at any part of the casing such that, for example, if a subsequent section of casing became jammed or could not otherwise be run in to the anticipated depth, the subsequent casing section could be expanded to its full diameter, even in the event that there was extensive overlap with the existing casing.

It will be apparent to those of skill in the art that the above described embodiments are merely exemplary of the present invention and that various modifications and improvements may be made thereto without departing from the scope of the invention. In particular, both aspects of the invention have application in a wide range of tubulars in addition to the forms described above.

I claim:

1. A method of locating and cementing a section of tubing in a drilled bore, comprising:

providing a tubing section for use in lining a bore;

running the tubing section into the bore;

passing cement slurry into the tubing section and directing the slurry into an annulus between the tubing section and the bore wall to substantially fill the annulus while maintaining a lower portion of the annulus substantially clear of cement; and expanding the lower portion of the tubing section.

2. The method of claim 1, further comprising running a further tubing section into the bore such that the lower portion of the tubing section and an upper portion of the further tubing section overlap, and expanding at least the upper portion of the further tubing section and the lower portion of the tubing section to couple the tubing sections.

3. The method of claim 1, wherein the tubing section is expanded before the cement slurry sets.

4. The method of claim 1, further comprising circulating fluid through the tubing section and out a lower end of the tubing section.

5. The method of claim 4, further comprising closing the lower end of the tubing section to prevent passage of fluid therethrough.

6. The method of claim 1, further comprising the opening cement outlets spaced from a lower end of the tubing section.

7. The method of claim 6, further comprising closing the cement outlets.

8. The method of claim 1, further comprising expanding the tubing section using a rotary expansion device.

9. A method of locating a tubing section in a drilled bore, comprising:

running a tubing section into the bore;

passing cement slurry into the tubing section and directing the slurry into an annulus between the tubing section and the bore wall to substantially fill the annulus while maintaining a lower portion of the annulus substantially clear of cement; and expanding a lower end portion of the tubing section.

10. A method of locating and cementing a section of tubing in a drilled bore, comprising:

running a first tubing section into the bore;

passing cement slurry into the first tubing section and directing the slurry into an annulus between the first tubing section and the bore wall to substantially fill the annulus while maintaining a lower portion of the annulus substantially clear of cement;

running a second tubing section into the bore such that a lower portion of the first tubing section and an upper portion of the second tubing section overlap; and expanding at least the upper portion of the second tubing section to engage and expand the lower portion of the first tubing section.

11. A method of locating a section of tubing in a drilled bore, comprising:

running a tubing section into the bore;

directing cement slurry into an annulus between the tubing section and the bore wall to substantially fill the annulus while restricting cement access to a portion of the annulus around a selected portion of the tubing section; and expanding the tubing section at the selected portion.

12. The method of claim 11, further comprising expanding the tubing section at said selected portion to form a tubing coupling.

13. The method of claim 11, further comprising expanding the tubing section at said selected portion to form a profile in the tubing section.

14. A method of creating a lined bore in an earth formation, comprising:

running a first tubing section into a drilled bore;

passing cement slurry into the first tubing section and directing the slurry into an annulus between the first tubing section and the bore wall to substantially fill the annulus, while restricting cement access to a lower portion of the annulus;

running a second tubing section into the bore such that a lower portion of the first tubing section and an upper portion of the second tubing section overlap; and expanding at least the upper portion of the second tubing section to engage and expand the lower portion of the first tubing section.

15. A lined bore produced by the method of claim 14.

16. A method of locating and cementing a section of tubing in a drilled bore, comprising:

providing a tubing section for use in lining a bore;

running the tubing section into the bore;

passing cement slurry into the tubing section and directing the slurry into an annulus between the tubing section and the bore wall to substantially fill the annulus while maintaining a lower portion of the annulus substantially clear of cement;

expanding the lower portion of the tubing section;

opening cement outlets spaced from a lower end of the tubing section; and closing the cement outlets by expanding the tubing section.

17. A method of locating and cementing a section of tubing in a drilled bore, comprising:

running a first tubing section into the bore;

passing cement slurry into the first tubing section and directing the slurry into an annulus between the first tubing section and the bore wall to substantially fill the annulus while maintaining a lower portion of the annulus substantially clear of cement;

expanding the first tubing section;

running a second tubing section into the bore such that a lower portion of the first tubing section and an upper portion of the second tubing section overlap; and expanding at least the upper portion of the second tubing section to engage and expand the lower portion of the first tubing section.

18. A method of locating a section of tubing in a drilled bore, comprising:

running a tubing section into the bore;

directing cement slurry into an annulus between the tubing section and the bore wall to substantially fill the annulus while restricting cement access to a portion of the annulus around a selected portion of the tubing section by a sleeve over the selected portion of the tubing section; and expanding the tubing section at the selected portion.

19. The method of claim 18, wherein cement slurry is circulated between an outer surface of the sleeve and the bore wall.

20. A method of creating a lined bore in an earth formation, comprising:

running a first tubing section into a drilled bore;

passing cement slurry into the first tubing section and directing the slurry into an annulus between the first tubing section and the bore wall to substantially fill the annulus, while restricting cement access to a lower portion of the annulus;

expanding the first tubing section;

running a second tubing section into the bore such that a lower portion of the first tubing section and an upper portion of the second tubing section overlap; and expanding at least the upper portion of the second tubing section to engage and expand the lower portion of the first tubing section.

* * * * *